US010716383B1

(12) United States Patent
Weiss

(10) Patent No.: US 10,716,383 B1
(45) **Date of Patent: *Jul. 21, 2020**

(54) MOBILE SALON CHAIR AND WORK STATION

(71) Applicant: Dustin Edward Weiss, Agoura Hills, CA (US)

(72) Inventor: Dustin Edward Weiss, Agoura Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/501,160

(22) Filed: Feb. 26, 2019

Related U.S. Application Data

(60) Division of application No. 15/731,312, filed on May 23, 2017, now Pat. No. 10,251,458, which is a continuation-in-part of application No. 13/280,170, filed on Oct. 24, 2011, now abandoned.

(60) Provisional application No. 61/438,003, filed on Jan. 31, 2011, provisional application No. 61/406,317, filed on Oct. 25, 2010.

(51) Int. Cl.

| | |
|---|---|
| ***A45D 19/04*** | (2006.01) |
| ***A45D 44/16*** | (2006.01) |
| ***A45D 44/02*** | (2006.01) |
| ***A47K 3/062*** | (2006.01) |
| ***A47C 1/06*** | (2006.01) |
| ***A47C 7/00*** | (2006.01) |
| ***A47C 1/11*** | (2006.01) |

(52) U.S. Cl.
CPC ..... *A45D 19/04* (2013.01); *A45D 44/02* (2013.01); *A45D 44/16* (2013.01); *A47C 1/06* (2013.01); *A47C 1/11* (2013.01); *A47C 7/006* (2013.01); *A47K 3/062* (2013.01)

(58) Field of Classification Search
CPC ..... A47K 3/062
USPC ..... 4/515–523, 479, 316–317, 458, 321
See application file for complete search history.

(56) References Cited

U.S. PATENT DOCUMENTS 10,251,458 B1 * 4/2019 Weiss ..... A47C 1/11

* cited by examiner

*Primary Examiner* — Lori L Baker
(74) *Attorney, Agent, or Firm* — D'Arcy H. Lorimer; Lorimer Labs

(57) ABSTRACT

A mobile salon chair, work station, and mobile shampoo bowl are described. The salon chair includes a storage container with a seat, backrest, and applicable electrical components. All system components can be stored within the salon chair for transportation to the client's location. The workstation provides tool storage for necessary hair grooming tools. The shampoo bowl is supported by a removable stand. The shampoo bowl has a drain and tubing so that used water can be captured. A clean water bladder is provided to store clean water. A submersible pump installed within the clean water bladder delivers water to the shampoo bowl. Used water from the drain in the shampoo bowl is stored within a second bladder. The clean water bladder is placed within the volume of the used water bladder.

8 Claims, 6 Drawing Sheets

MOBILE SALON CHAIR AND WORK STATION

REFERENCES TO PRIOR APPLICATIONS

This application is a divisional continuing application of co-pending non-provisional application Ser. No. 15/731,312, filed May 23, 2017, which is a continuation in part of abandoned non-provisional application Ser. No. 13/280,170, filed Oct. 24, 2011, entitled MOBILE SALON CHAIR AND WORK STATION; which is a non-provisional application of provisional application No. 61/406,317, filed on Oct. 25, 2010 and provisional application No. 61/438,003, filed on Jan. 31, 2011 and claims benefit thereof. Application Ser. No. 15/731,312, 13/280,170, 61/406,317, and 61/438,003 are hereby incorporated by reference.

BACKGROUND OF THE INVENTION

The present invention relates to a salon chair and, more particularly, to a portable and mobile salon chair that also operates as a work station and to a portable and mobile shampoo bowl.

Salons have long been known in the art. Typically, an individual travels to a salon for a hair treatment. However, in many cases, it may be desirable or necessary for the individual receiving the hair treatment to stay at their home or work site. As the population ages, the elderly in particular, will be in need of remotely delivered hair grooming services. Likewise, the disabled, the infirmed, and the bed ridden are also suitable for such services. Routine hair grooming is required not only for proper hygiene of these individuals, but is considered to be a service which adds considerably to the quality of life. Currently, no system exists that allows hair care professionals to deliver salon quality services outside of the hair salon premises. The difficulty of providing running water (and collecting the effluent water) has made providing remote salon hair grooming services very challenging, if not impossible.

Further, the concept can be extended to grooming our four legged friends as well.

Thus, a continuing need exists for a mobile salon chair that allows the salon technician to travel, with their work station and salon chair, to an individual's home or work site.

These and other limitations of the prior art will become apparent to those of skill in the art upon a reading of the following descriptions and a study of the several figures of the drawing.

SUMMARY OF THE INVENTION

It is an object of the present invention to provide a system for mobile salon hair care services, including: a mobile shampoo bowl having a sink for washing a client's hair, a support bracket, and a drain in the sink; a first water storage bladder for storing clean water; a second water storage bladder for storing water drained from the sink, the first water storage bladder being enclosed within the second water storage bladder, the water drained from the sink in contact with the outer surface of the first water storage bladder, the first water storage bladder preventing the mixing of the clean water with the water drained from the sink; a submersible pump disposed within the first water storage bladder, the submersible pump operative to deliver clean water to the mobile shampoo bowl for washing the client's hair; a drain tube connecting the drain fitting to the second water storage container; and a support stand removably coupled to the support bracket on the mobile shampoo bowl, the support stand operative to provide support for the mobile shampoo bowl.

It is another object of the present invention to provide a system for mobile salon hair care services, including: a mobile shampoo bowl having a sink for washing a client's hair, a support bracket, and a drain in the sink; a first water storage bladder for storing clean water; a second water storage bladder for storing water drained from the sink, the first water storage bladder being enclosed within the second water storage bladder, the water drained from the sink is in contact with the outer surface of the first water storage bladder, the first water storage bladder preventing the mixing of the clean water with the water drained from the sink; a submersible pump disposed within the first water storage bladder, the submersible pump operative to deliver clean water to the mobile shampoo bowl for washing the client's hair; a drain tube connecting the drain fitting to the second water storage container; a support stand removably coupled to the support bracket on the mobile shampoo bowl, the support stand operative to provide support for the mobile shampoo bowl; a mobile salon chair having a removable lid, a seat and a reclining seat back disposed on the removable lid, the mobile salon chair having a storage volume contained within, the storage volume accessed by removal of the lid, the mobile salon chair having a vacuuming device integrated within the storage volume; and a workstation having collapsible support legs, the workstation providing storage for tools used in providing hair grooming services, the workstation being stowed within the mobile salon chair.

It is yet another object of the present invention to provide a system for mobile grooming services for animals, comprising: a mobile shampoo bowl having a sink for washing an animal; a mobile salon chair, the shampoo bowl integrated within the mobile salon chair, the mobile salon chair having a storage volume contained within the mobile salon chair, the storage volume accessed by removal of the shampoo bowl, the mobile salon chair having a vacuuming device integrated within the storage volume; a first water storage bladder for storing clean water; a second water storage bladder for storing water drained from the sink in the mobile shampoo bowl, the first water storage bladder being enclosed within said second water storage bladder, the water drained from the sink is in contact with the outer surface of the first water storage bladder, the first water storage bladder preventing the mixing of the clean water with the water drained from the sink; a submersible pump being disposed within the first water storage bladder, operative to deliver clean water to the mobile shampoo bowl for washing the animal; and a workstation having collapsible support legs, providing storage for tools used in delivering animal grooming services, the workstation stowable within the storage volume contained within the mobile salon chair.

These and other embodiments, features and advantages will become apparent to those of skill in the art upon a reading of the following descriptions and a study of the several figures of the drawing.

BRIEF DESCRIPTION OF THE DRAWINGS

Several example embodiments will now be described with reference to the drawings, wherein like components are provided with like reference numerals. The example embodiments are intended to illustrate, but not to limit, the invention. The drawings include the following figures.

DETAILED DESCRIPTION OF THE PREFERRED EMBODIMENTS

Figure 1E:
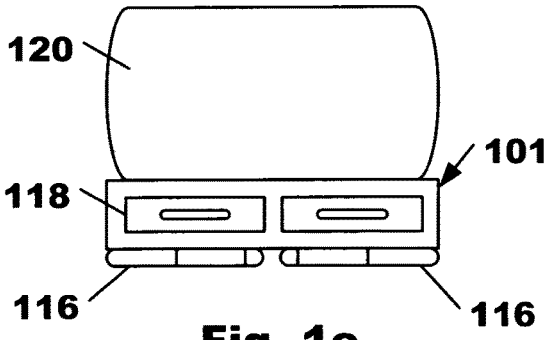
FIG. 1*e* is a view of a work station, in accordance with an example embodiment of the present invention.

The present invention relates to a salon chair and, more particularly, to a portable and mobile salon chair 100 that also contains an integrated a work station 101, as described herein. The mobile salon chair 100 comprises a storage container having wheels, tote handle, a seat, backrest, vacuum device, and applicable electrical components.

Also described is a mobile shampoo bowl 200 of FIG. 2. The mobile shampoo bowl 200 has a drain 228 and is attached such that it can extend or telescope from the bowl. A clean water bladder 212 is provided with the bowl and has a submersible pump 220, hose 224, and spray head 226 to allow a user to pump water from the clean water bladder 212, through the hose 224 and spray head into the washing bowl 202. Finally, a dirty water bladder 210 is connected to the drain 228 of the wash bowl 202 to collect water passing through the washing bowl 202.

The present invention relates to a mobile salon chair 100 that includes several features that allow the mobile salon chair 100 to provide storage for a work station 101, and a portable shampoo bowl 200. For example and as shown in FIGS. 1*a-d*, the mobile salon chair 100 includes a vacuum device (not shown) and power outlets 112. Power outlets 112 are mounted inside the mobile salon chair 100 at the bottom with access to them from the back of the box (FIG. 1*d*). The seat 102 is mounted to the top of the mobile salon chair 100 to the lid 114. The lid 114 can be removed via a lift-off and quick disconnect latch hinge (not shown).

The mobile salon chair 100 is fully self-contained and has a workstation 101 and portable shampoo bowl 200 that comes out of a storage volume within the mobile salon chair 100. The work-station 101 shown in FIG. 1*e* has drawers 118 and a mirror 120 that folds up and down. Work station 101 has folding, telescoping legs 116 for proper table height. The mobile salon chair 100 chair also includes electrical components, such as a vacuum, power cord 110, and electrical outlets 112. A vacuum hose (not shown) has a place for storage on outside of the box. The vacuum is a unit mounting inside of mobile salon chair 100. The power cord is retractable and is stored on a reel 111 at the bottom inside of mobile salon chair 100 (see FIGS. 1*b*, 1*d*). The handle 108 for travel doubles as a foot rest when working on a client. The handle 108 folds up and down able to lock every 10 degrees. The backrest on the chair 102 lays flat for travel. There is a locking hinge for the seat back "position" (not shown). In one example embodiment, there are two drawers 118 on side of work station 101 for tool storage. The drawers 118 both have button type lock to keep closed when traveling. In another example embodiment, there is a place for mobile phone dock on the outside of the mobile salon chair 100 (not shown). [0024] In another example embodiment, the mobile salon chair 100 can include a 12 volt rechargeable system. In other example embodiments, it can also be devised to include a motor in the lid for up and down movement of the chair 102, or include a rotating hinge to allow the chair 102 to swivel in side to side movement (not shown). Further, a tall backrest can be included with a built-in telescoping head rest (not shown).

As shown in FIGS. 2 *a,b*, the present invention includes a portable shampoo bowl 200. It should be understood that while the portable shampoo bowl 200 is shown as a separate and standalone item, it can also be attached with the mobile salon chair 100 (not shown). In one example embodiment, the portable shampoo bowl 200 is 13 and one half inches wide and 14 inches long, with a 4 inch lip for shampoo and conditioner dispenser and that is 6 inches deep, with a molded drain so it is one piece. In another example embodiment, the wash bowl 202 can be telescoping (not shown) and collapsible for storage. When collapsed, the shampoo bowl is like a top tray in a tool box. There are two collapsible water bladders 210, 212 under the portable shampoo bowl 200. One bladder 212 is inside the other 210. In one example embodiment, clean water 216 is stored inside bladder 212, while dirty water 218 is held in the outer bladder 210. A port with a lid is included so that the pump 220 can access the clean water 216. In another example embodiment, pump 220 is battery powered. Optionally, the mobile salon chair 100 includes an access door in the back of the box to access the water storage bladders, which may be stored within (not shown). In another example embodiment, a lid may be used to cover the shampoo bowl when transporting it (not shown).

Returning to FIGS. 1 *a-d*, FIGS. 1 *a-d* are views of a portable salon chair 100, in accordance with example embodiments of the present invention. FIG. 1 *a,b* are side views of portable salon chair 100 having a collapsible travel handle 108, wheels 106, vacuum hose port 104, seat 102 (shown collapsed), and lid 114. FIGS. 1 *c,d* are end views of portable salon chair 100 having electrical outlets 112 and electrical power plug 110. Power cord attached to plug 110 is stored on a reel 111 contained within portable salon chair (FIGS. 1*b*, 1*d*). Portable salon chair 100 serves a number of purposes in the portable salon system of the present invention.

Firstly, it provides containment storage for all the components (see FIGS. 2, 4, 5 below) so they can easily relocated to the place where the client's hair grooming services will be provided. It is important that all the system components (which comprise a wash bowl 202, water storage bladders 230, submersible pump 220, tubing 224, 228, stand 206, spray nozzle 226, vacuum, and work station 101) are stored within the portable salon chair 100.

Secondly, it provides seating for the client if required while hair grooming services are provided.

Thirdly, it provides support facilities such as a built in vacuum to clean clippings from the client and auxiliary AC power for hair dryers, if required. In alternative embodiments of the present invention, the support facilities may include DC charging for a DC powered vacuum system as well as rechargeable batteries for same. Low voltage DC power is often advantageous when working remotely on wet clients.

Figure 1D:
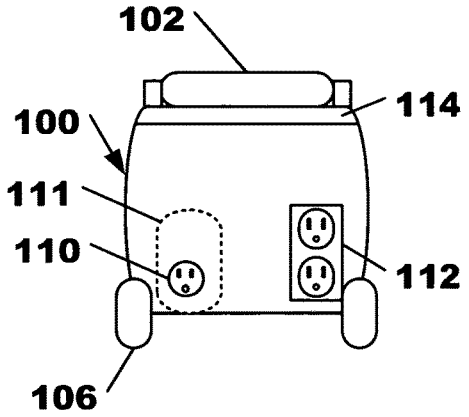
FIGS. 1*a-d* are views of a portable salon chair, in accordance with example embodiments of the present invention.
Figure 1B:
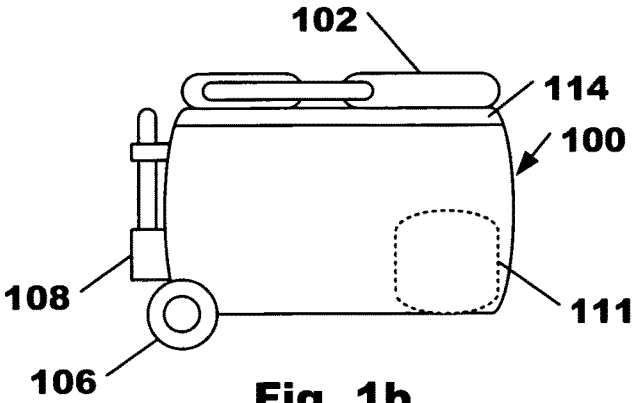
Figure 1C:
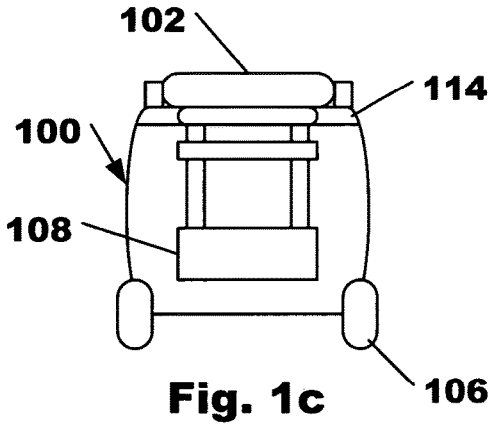
Figure 1A:
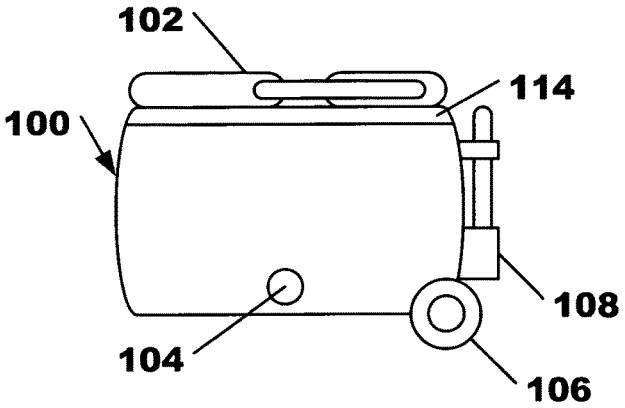

FIG. 1*e* is a side view of a work station 101 in accordance with an example embodiment of the present invention. Work station 101 comprises tool storage drawers 118, foldable mirror 120, and collapsible support legs 116 (shown in stowed position). Work station 101 provides storage for various hair grooming tools such as scissors, hair dryers, combs, and other tools as will be known to those skilled in the art. Mirror 120 folds down to cover the top of workstation 101 for stowage when not in use. Support legs 116 unfold and extend in a telescoping manner to provide a proper working height (not shown). Work station 101 is stored within portable salon chair 100 (see FIGS. 4,5 below) when being transported or not in use.

Returning to FIG. 2*a*, FIG. 2*a* is a side view 200 of a portable shampoo bowl, in accordance with an example embodiment of the present invention. Portable shampoo bowl 200 comprises hair wash bowl 202, support stand bracket 204, collapsible support stand 206, water storage bladders 208, submersible pump 220, spray nozzle 226, clean water feed tubing 224, drain tubing 228, pump battery container 232, and pump wiring 222. Water storage bladders 208 are contained, in one example embodiment, a flexible canvas or plastic bag 234. In another example embodiment, container 234 can be a rigid container. Submersible pump 220 is inserted into a flexible clean water bladder 212 which resides inside a second flexible contaminated water bladder 210. Clean water 216 from inside bladder 212 is delivered to spray nozzle 226 via battery powered pump 220. Contaminated water from wash bowl 202 containing soap and hair clippings from the client is delivered to the contaminated bladder 210 via drain tubing 228. The contaminated water 218 contained within the outer bladder 210 aids in providing head pressure for pumping the clean water 216, so that all the clean water can be effectively pumped without starvation of submersible pump 220. The water capacity of the outer contaminated water bladder 210 is sized such that it is greater than or equal to the volume of clean water stored within bladder 212. Prior to usage, warm water of a suitable temperature is placed into the clean water bladder 212 (having removed detachable submersible pump 220), with the outer bladder 210 empty. After all the clean water is used, bladders 208 can be removed by disconnecting the pump and drain tubing 228, and the contaminated water 218 emptied through fitting 214 into a suitable location. Refilling of the clean water bladder 212 can then occur via the open submersible pump fitting.

Figure 2A:
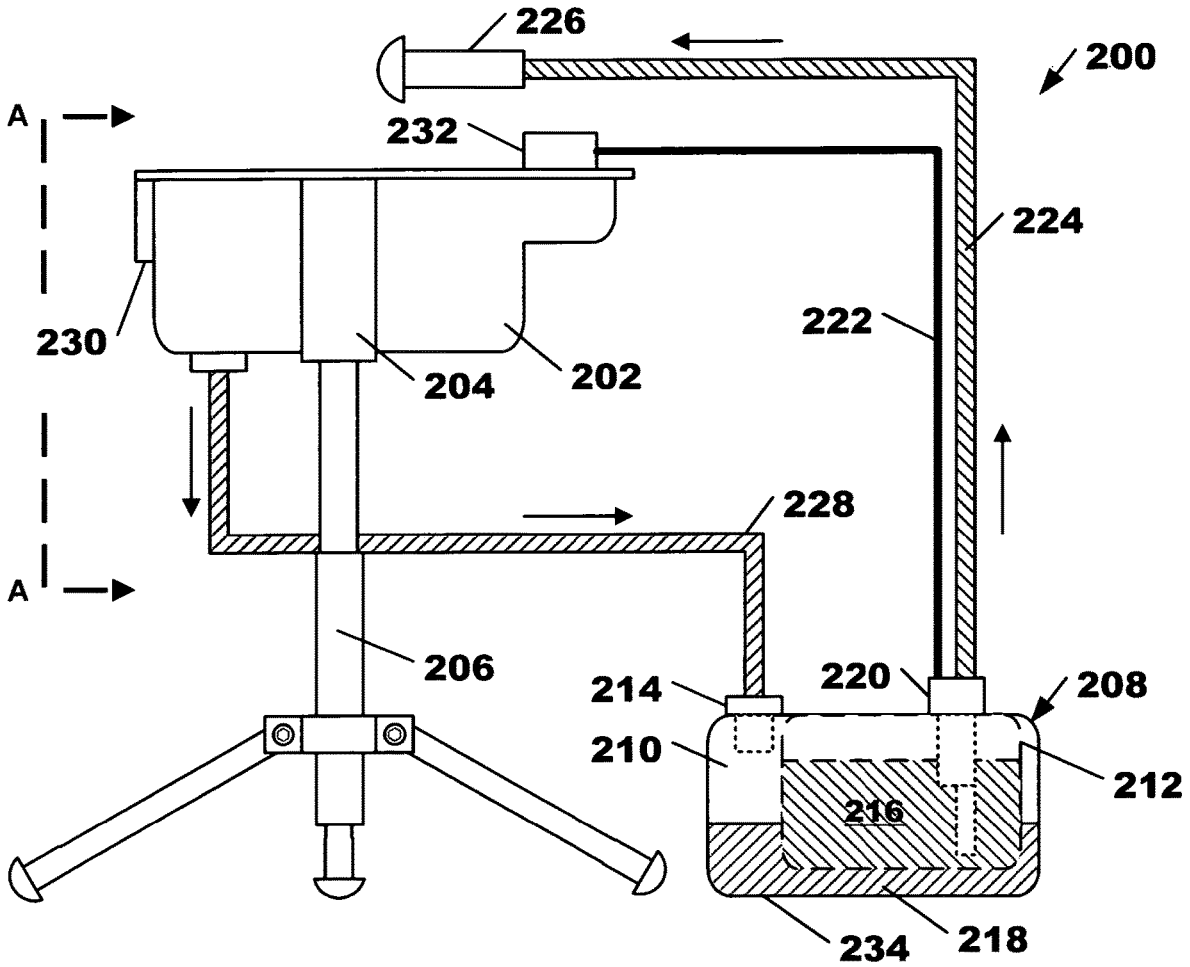
FIG. 2*a* is a side view of a portable shampoo bowl, in accordance with an example embodiment of the present invention.
Figure 2B:
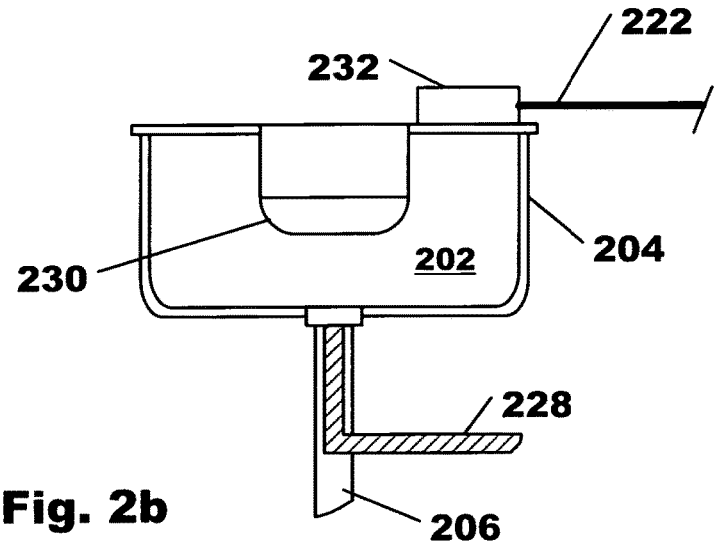
FIG. 2*b* is an end view via section A-A of FIG. 2*a*, in accordance with an example embodiment of the present invention.

FIG. 2*b* is an end view via section A-A of FIG. 2*a*, in accordance with an example embodiment of the present invention. Wash bowl 202 has a cutout 230 for the neck of the client, allowing for more comfortable hair washing.

Figure 3:
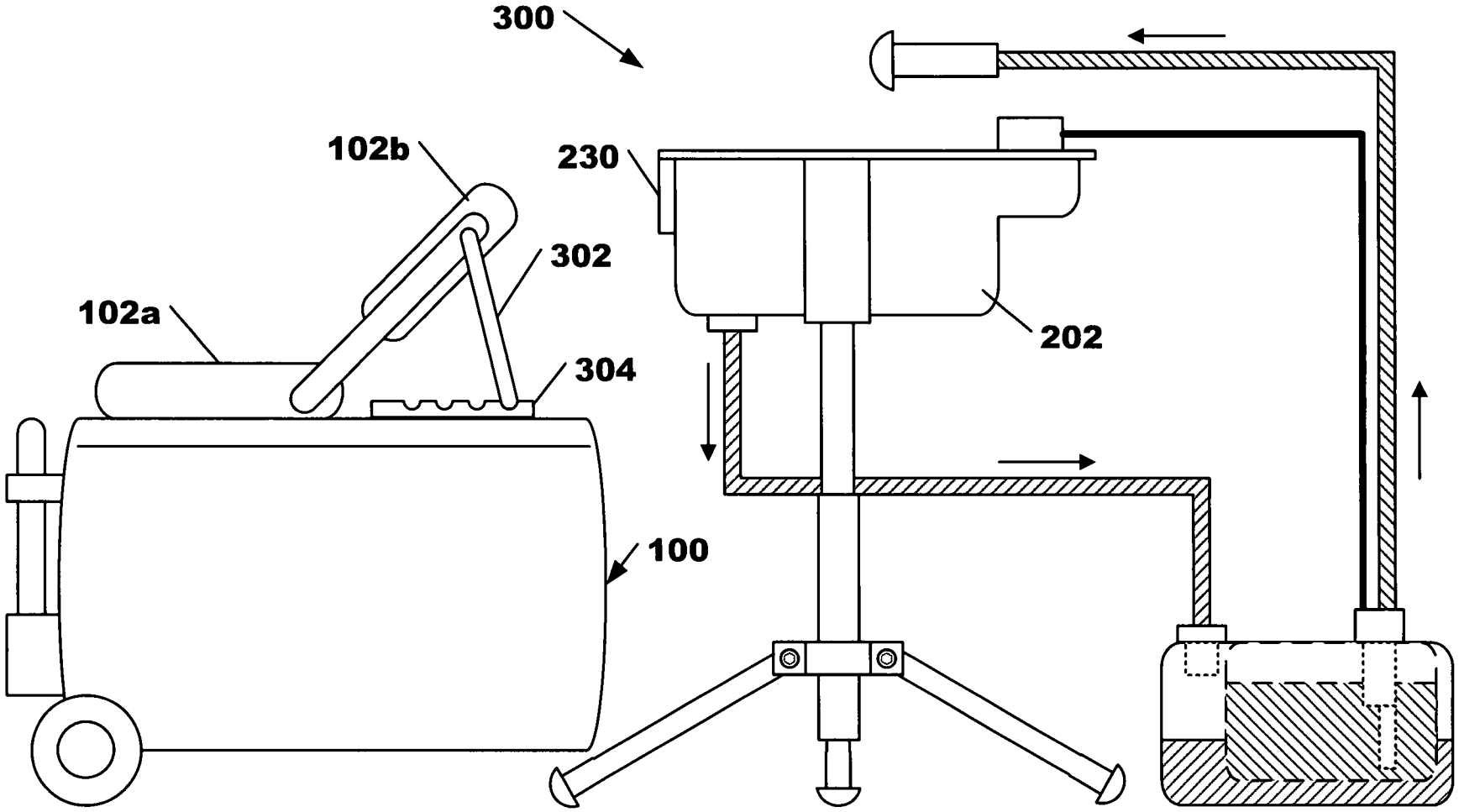
FIG. 3 is a side view of a portable salon chair and shampoo bowl, in accordance with an example embodiment of the present invention.

FIG. 3 is a side view 300 of a portable salon chair 100 and portable shampoo bowl 200, in accordance with an example embodiment of the present invention. The figure illustrates the portable salon chair placed adjacent to the shampoo bowl to service a client. The seat 102*a,b* is shown with the backrest 102*b* elevated and locked at an angle to support the back of the client. In one example embodiment of the present invention, an indexed bracket 304 allows pivoting member 302 to lock the angular position of backrest 102*b* in place. For the case of bedridden clients, the portable shampoo bowl would be placed adjacent to the client's bed (not shown) and the portable salon chair 100 would not be used to support the client. In a similar manner, clients in wheel chairs could be serviced by placing the wheel chair adjacent to the portable shampoo bowl (not shown).

Figure 4:
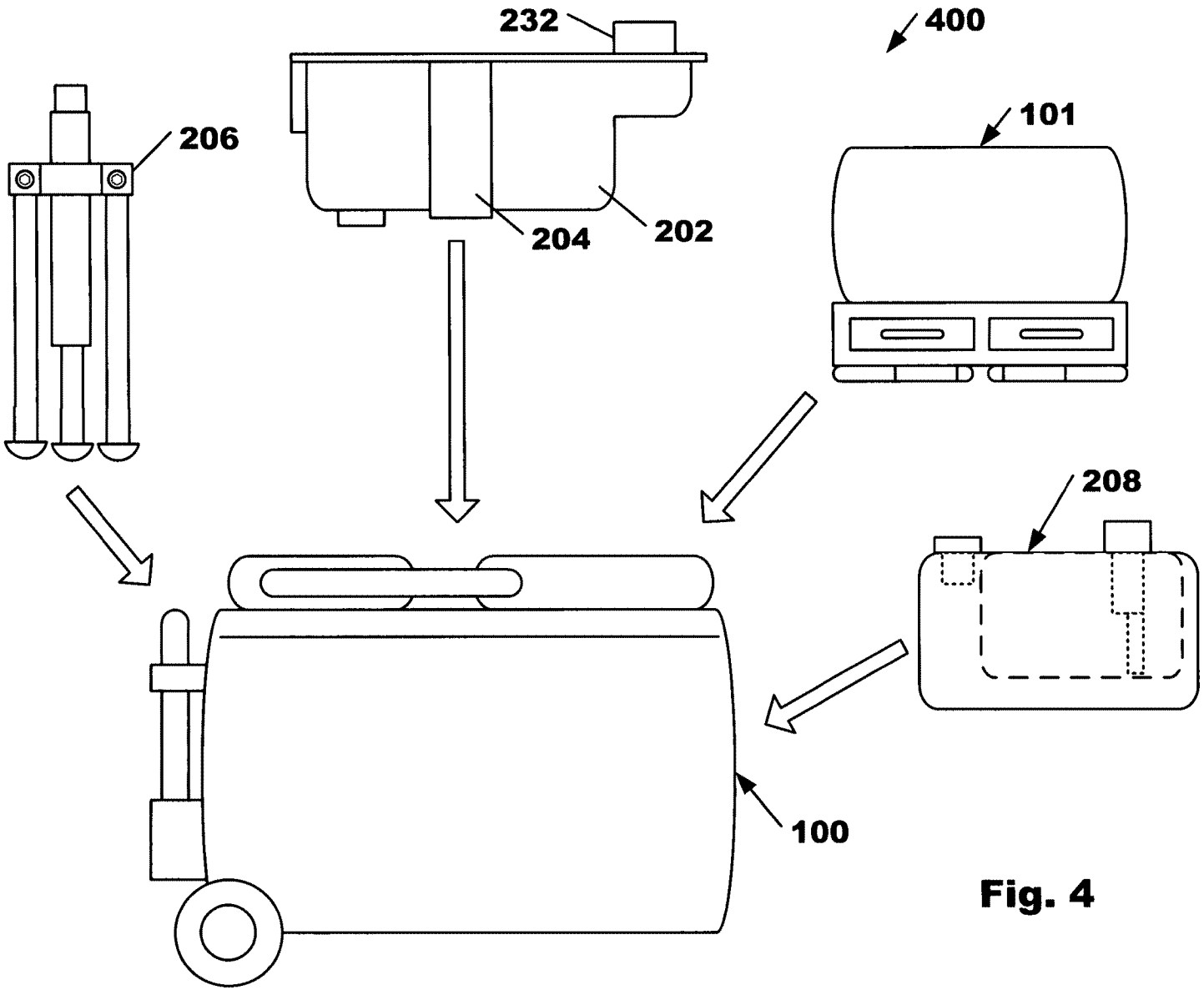
FIG. 4 is a schematic view of the components of the portable salon chair and shampoo bowl, in accordance with an example embodiment of the present invention.

FIG. 4 is a schematic view 400 of the components of the portable salon chair and shampoo bowl, in accordance with example embodiments of the present invention. Each of the major components of the portable salon hair care servicing system are designed to break down and be stored in the interior of the portable salon chair 100. This is to allow the complete system to be easily moved and relocated to where the client is. The system must allow the hair care professional to have all the tools and resources required to provide complete hair grooming services, which may include (but are not limited to) hair washing, hair cutting, styling, and drying. Since running water and sinks are not often available, the system provides a source of water for hair washing, and a means of discarding used rinse water neatly. Tools such as cutting scissors, combs, and hair dryers are stored within the work station 101. With its support legs folded and mirror folded, the compact assembly is sized to fit into the portable salon chair 100. Wash bowl 202 detaches from support legs 206 via a connector on bracket 204 so both can be stowed within the portable salon chair 100. Water storage bladders 208 are collapsible when empty, and can be easily tucked into any available space, such as the inside of bowl 202, along with the spray nozzle, drain and feed tubing.

Figure 5:
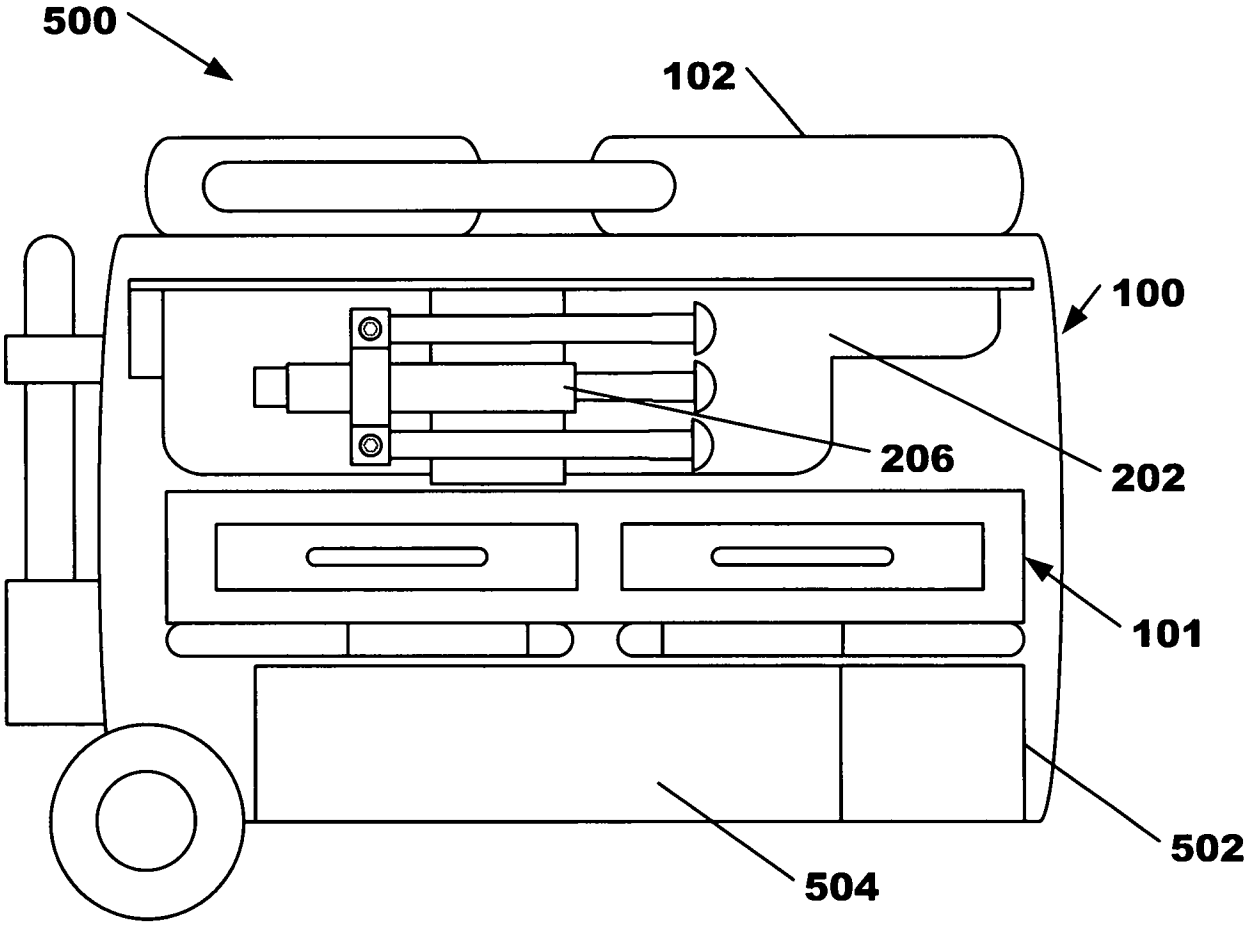
FIG. 5 is a cut away view of the components of the portable salon chair and shampoo bowl being stored with the portable salon chair, in accordance with an example embodiment of the present invention.

FIG. 5 is a cut away view 500 of the components of the portable salon chair and shampoo bowl being stored with the portable salon chair, in accordance with an example embodiment of the present invention. The various components described in previous figures are sized so that they will all fit in the containment space provided by the portable salon chair 100. In addition to the components described in FIG. 4, additional utilities can be placed within the portable salon chair. As alluded to earlier, a vacuum device 504 may be provided in one example of the present invention. The vacuum may be AC 110V powered or, preferably, battery powered. Battery operation has the advantage of being low voltage, which is desirable when working on or near wet clients. Device 504 may also contain built in filters or dirt containment chambers (not shown). An auxiliary device 502 may also be provided. Device 502 may be batteries to power various devices, or an AC buss or distribution system as shown in FIGS. 1*a-d*.

Figure 6:
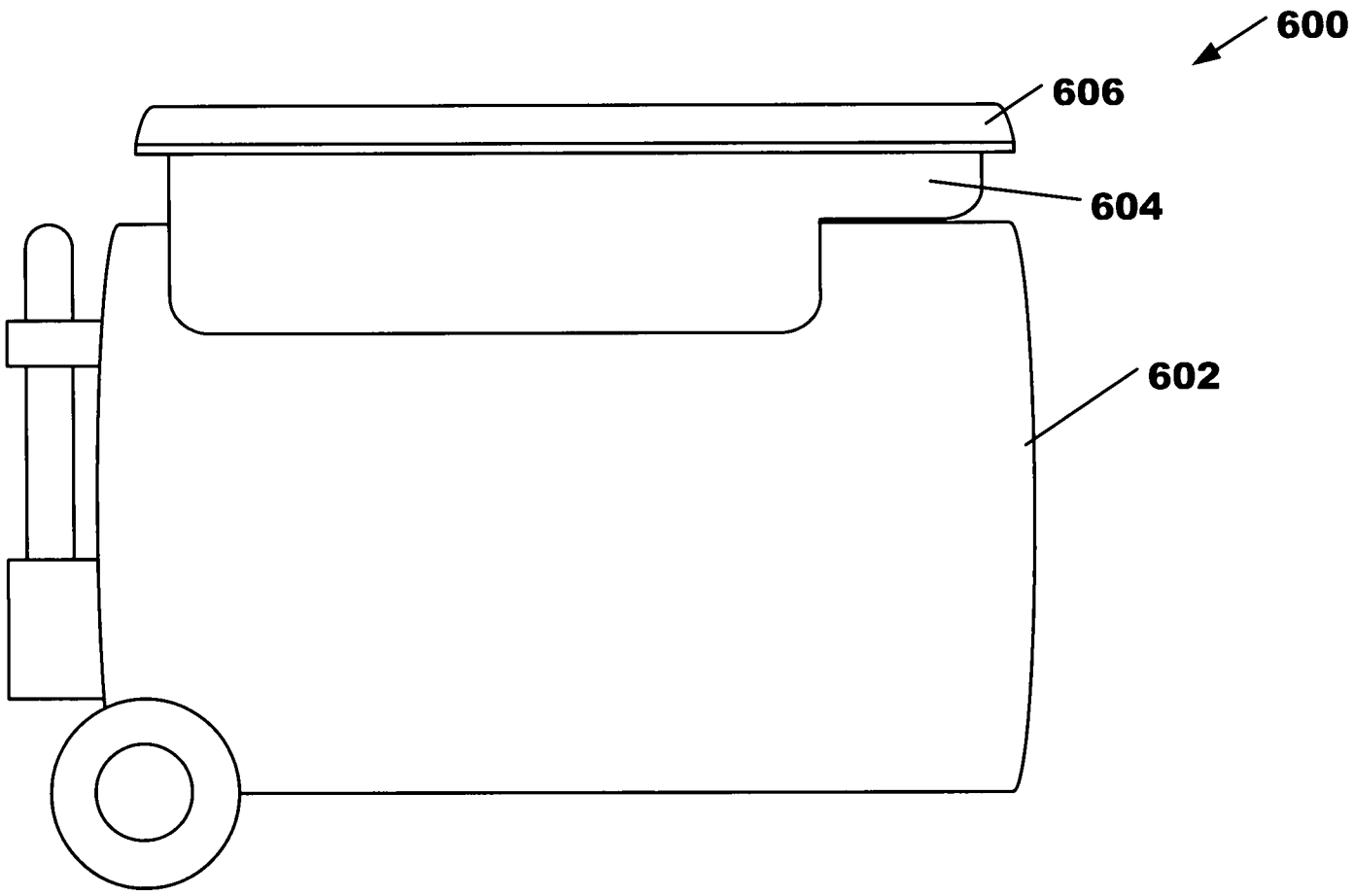
FIG. 6 is a side view of a portable salon chair for washing animals, in accordance with an example embodiment of the present invention.

FIG. 6 is a side view 600 of a portable salon chair for washing animals, in accordance with an example embodiment of the present invention. The concept of providing mobile salon and hair grooming services can be extended to animals, particularly canines. A portable salon chair 602 for animal services is illustrated. In this example embodiment, the washing bowl 604 would be integrated into the top section of the salon chair 602. The pump and water bladders are contained with the storage volume of chair 602 (not shown). Having a separate wash bowl on a stand (as illustrated previously) would not be practical for larger animals, since generally animals have to be fully contained in the bath for grooming. Placing the bowl 604 on the portable salon chair 602 provides better stability when handling large canines. A lid 606 can be provided to cover wash bowl 604 during transportation. A work station having collapsible legs and tool storage can be provided and stowed within salon chair as in previously disclosed embodiments (not shown). A built in vacuum can also be provided (not shown). To access storage and water storage bladders, wash bowl 604 is removed via latches or hinges (not shown).

Although various embodiments have been described using specific terms and devices, such description is for illustrative purposes only. The words used are words of description rather than of limitation. It is to be understood that changes and variations may be made by those of ordinary skill in the art without departing from the spirit or the scope of various inventions supported by the written disclosure and the drawings. In addition, it should be understood that aspects of various other embodiments may be interchanged either in whole or in part. It is therefore intended that the claims be interpreted in accordance with the true spirit and scope of the invention without limitation or estoppel.

What is claimed is:

1. A system for providing mobile grooming services for animals, comprising:

a mobile shampoo bowl, said mobile shampoo bowl having a sink for washing an animal;

a mobile salon chair, said mobile shampoo bowl integrated within said mobile salon chair, said mobile salon chair having a storage volume contained within said mobile salon chair, said storage volume accessed by removal of said mobile shampoo bowl, said mobile salon chair having a vacuuming device integrated within said storage volume;

a first water storage bladder for storing clean water;

a second water storage bladder for storing water drained from said sink in said mobile shampoo bowl, said first water storage bladder being enclosed within said second water storage bladder, said water drained from said sink in contact with an outer surface of said first water storage bladder, said first water storage bladder preventing the mixing of said clean water with said water drained from said sink;

a submersible pump, said submersible pump being disposed within said first water storage bladder, said submersible pump operative to deliver said clean water to said mobile shampoo bowl for washing said animal; and, a workstation, said workstation having collapsible support legs, said workstation providing storage for tools used in providing animal grooming services, said workstation stowable within said storage volume contained within said mobile salon chair.

2. The system as recited in claim 1, wherein said submersible pump is battery operated.

3. The system as recited in claim 1, wherein said clean water is delivered to said mobile shampoo bowl with a flexible tube coupled to an output of said submersible pump.

4. The system as recited in claim 3, wherein a first end of said flexible tube is coupled to said output of said submersible pump, a second end of said flexible tube is coupled to a spray nozzle.

5. The system as recited in claim 1, wherein said vacuuming device is battery operated.

6. The system as recited in claim 1, wherein said mobile salon chair contains AC receptacles, said AC receptacles getting power from an AC extension cord, said AC extension cord being stored on a reel disposed within said storage volume contained within said mobile salon chair.

7. The system as recited in claim 1, wherein said mobile salon chair is equipped with wheels and a collapsible travel handle.

8. The system as recited in claim 1, wherein said mobile shampoo bowl, said first and said second water storage bladders, said submersible pump, said vacuuming device, said support stand, and said workstation are contained within said storage volume of said mobile salon chair.

* * * * *